US009303861B2

(12) United States Patent
Li et al.

(10) Patent No.: US 9,303,861 B2
(45) Date of Patent: Apr. 5, 2016

(54) LIGHT EMITTING DIODE LIGHT SOURCE MODULES

(75) Inventors: Qing (Charles) Li, Las Vegas, NV (US); Yangcheng Huang, Guangdong (CN); Haijun Wang, Guangdong (CN); Guowen Lei, Guangdong (CN); Cuie Wei, Guangdong (CN); Menghua Long, Guangdong (CN); GuiLin Wang, Guangdong (CN)

(73) Assignee: US VAOPTO, Inc., Las Vegas, NV (US)

( * ) Notice: Subject to any disclaimer, the term of this patent is extended or adjusted under 35 U.S.C. 154(b) by 670 days.

(21) Appl. No.: 12/975,445

(22) Filed: Dec. 22, 2010

(65) Prior Publication Data

US 2012/0002407 A1 Jan. 5, 2012

(30) Foreign Application Priority Data

Sep. 14, 2009 (CN) ..... 201020528196.9
Dec. 22, 2009 (CN) ..... 200920264978.3

(51) Int. Cl.
*F21V 7/20* (2006.01)
*F21V 31/04* (2006.01)
(Continued)

(52) U.S. Cl.
CPC ..... *F21V 31/04* (2013.01); *F21S 4/001* (2013.01); *F21Y 2101/02* (2013.01)

(58) Field of Classification Search
CPC . F21Y 2103/003; F21V 17/12; F21V 19/002; F21V 19/003; F21V 19/0035; F21V 19/0055; F21V 7/0083; F21V 7/041; F21V 31/04; F21S 4/001
USPC ..... 362/218, 219, 249.02, 217.1, 217.11, 362/217.01, 222–225, 227, 249.01
See application file for complete search history.

(56) References Cited

U.S. PATENT DOCUMENTS 4,259,710 A * 3/1981 Schlack ..... 362/267
4,954,932 A * 9/1990 Isenga ..... 362/477
(Continued)

FOREIGN PATENT DOCUMENTS

CN 1596049 A 3/2005
CN 2703295 6/2005
CN 2824292 10/2006

*Primary Examiner* — Mary McManmon
(74) *Attorney, Agent, or Firm* — New River Valley IP Law, P.C.; Michele L. Mayberry

(57) ABSTRACT

The present invention provides a highly-protective, heat dissipating LED light source module that may be waterproof or non-waterproof. In an embodiment, the present invention provides an LED light source module comprising: a waterproof housing comprising a metal substrate and a plastic cover integrally disposed on one or more surfaces of the metal substrate; and at least one light emitting diode, electronic component, and power line disposed on and operably connected with the metal substrate and encapsulated thereon by the plastic cover. In other embodiments are provided LED light source modules comprising: a circuit board with at least two through holes disposed at selected positions; at least one light emitting diode, electronic component, and power line disposed on the circuit board and operably connected therewith; and a plastic cover comprising at least two pins disposed and shaped for interconnection with corresponding through holes of the circuit board. The simple LED light source models disclosed may be efficiently and inexpensively produced and are capable of withstanding the harsh environments in which they are sometimes used.

20 Claims, 8 Drawing Sheets

(51) Int. Cl.
*F21S 4/00* (2006.01)
*F21Y 101/02* (2006.01)

(56) References Cited

U.S. PATENT DOCUMENTS

| | | | | |
|---|---|---|---|---|
| 6,428,189 | B1 | 8/2002 | Hochstein | |
| 6,450,664 | B1 * | 9/2002 | Kelly | 362/244 |
| 6,498,355 | B1 | 12/2002 | Harrah et al. | |
| 6,501,084 | B1 | 12/2002 | Sakai et al. | |
| 6,517,218 | B2 | 2/2003 | Hochstein | |
| 6,552,658 | B1 * | 4/2003 | Roller et al. | 340/475 |
| 6,648,498 | B1 * | 11/2003 | Tsao | 362/235 |
| 6,837,598 | B2 * | 1/2005 | Marcus | 362/374 |
| 6,874,910 | B2 | 4/2005 | Sugimoto et al. | |
| 6,888,723 | B2 * | 5/2005 | Kamiya et al. | 361/715 |
| 6,922,339 | B2 | 7/2005 | Nakamura et al. | |
| 6,924,973 | B2 | 8/2005 | Kim | |
| 7,008,079 | B2 * | 3/2006 | Smith | 362/235 |
| 7,175,306 | B2 * | 2/2007 | Pan | 362/245 |
| 7,192,163 | B2 | 3/2007 | Park | |
| 7,210,957 | B2 * | 5/2007 | Mrakovich et al. | 439/404 |
| D544,972 | S * | 6/2007 | Coushaine | D26/37 |
| 7,245,279 | B2 | 7/2007 | Wang | |
| 7,281,818 | B2 * | 10/2007 | You et al. | 362/241 |
| 7,296,916 | B2 | 11/2007 | Ouderkirk et al. | |
| 7,445,352 | B2 * | 11/2008 | Lin | 362/101 |
| 7,494,250 | B2 | 2/2009 | Chen | |
| 7,495,322 | B2 | 2/2009 | Hashimoto et al. | |
| 7,679,918 | B2 | 3/2010 | Kim | |
| 7,686,477 | B2 * | 3/2010 | Southard et al. | 362/249.04 |
| 7,703,941 | B2 * | 4/2010 | Lee | 362/219 |
| 7,808,786 | B2 | 10/2010 | Liang et al. | |
| 7,832,896 | B2 * | 11/2010 | Saha et al. | 362/240 |
| 7,952,114 | B2 * | 5/2011 | Gingrich, III | 257/99 |
| 8,092,042 | B2 * | 1/2012 | Wilcox | 362/249.02 |
| 8,159,131 | B2 * | 4/2012 | Helbing | 313/512 |
| 8,262,253 | B2 * | 9/2012 | Zlotnikov et al. | 362/245 |
| 2002/0003700 | A1 * | 1/2002 | Selkee | 362/249 |
| 2002/0036908 | A1 * | 3/2002 | Pederson | 362/545 |
| 2004/0080939 | A1 * | 4/2004 | Braddell et al. | 362/240 |
| 2005/0073840 | A1 | 4/2005 | Chou et al. | |
| 2005/0128744 | A1 * | 6/2005 | You et al. | 362/241 |
| 2005/0152128 | A1 * | 7/2005 | Campman | 362/95 |
| 2006/0250270 | A1 | 11/2006 | Tangen | |
| 2007/0211458 | A1 * | 9/2007 | Bertram et al. | 362/227 |
| 2007/0291473 | A1 * | 12/2007 | Traynor | 362/106 |
| 2008/0089064 | A1 | 4/2008 | Wang | |
| 2008/0198597 | A1 | 8/2008 | Blumel | |
| 2008/0244944 | A1 * | 10/2008 | Nall et al. | 40/544 |
| 2009/0067169 | A1 * | 3/2009 | Helbig et al. | 362/234 |
| 2009/0067172 | A1 * | 3/2009 | Inoue et al. | 362/240 |
| 2009/0154182 | A1 * | 6/2009 | Veenstra et al. | 362/487 |
| 2009/0213583 | A1 * | 8/2009 | Chang et al. | 362/218 |
| 2010/0008090 | A1 * | 1/2010 | Li et al. | 362/249.03 |
| 2010/0110679 | A1 * | 5/2010 | Teng et al. | 362/235 |
| 2010/0110703 | A1 | 5/2010 | Chiang et al. | |
| 2011/0085334 | A1 | 4/2011 | Wang | |

* cited by examiner

LIGHT EMITTING DIODE LIGHT SOURCE MODULES

CROSS-REFERENCE TO RELATED APPLICATIONS

This application claims priority to and the benefit of the filing date of China Patent Application No. 2009/20264978.3, filed on Dec. 22, 2009 and China Patent Application No. 2010/20528196.9, filed on Sep. 14, 2010, both of which are hereby incorporated by reference herein in their entireties.

BACKGROUND OF THE INVENTION

1. Field of the Invention

The present invention is directed to light emitting diode light source modules. More particularly, the present invention relates to simple structured LED modules that provide for quick, easy and lower cost manufacturing. In certain embodiments, the LED modules described here may be outdoor waterproof LED modules with enhanced heat dissipating performance.

2. Description of Related Art

LEDs have grown increasingly popular as an energy-efficient light because of their high efficiency, long service life, good shock resistance, damage resistance, energy-saving and environmental benefits. Currently, LED light source modules have been widely applied in fields such as luminous characters, advertisement, sign boards, light boxes, environment and adornment illumination, city lighting engineering, stage lighting and so on to replace conventional light sources. In many of these applications, LED light source modules are used outdoors, which could benefit from water and heat damage resistance.

Traditional LED light sources mainly comprise a case, a circuit board and other components, such as LEDs and integrated circuits. In traditional waterproof LED light sources, these components are potted and connected together by epoxy resin (typically, a thermosetting plastic) to achieve optimal waterproof performance. However, potting in a large area with epoxy resin causes the circuit board, LED and case to be solidified as a whole. This may not be optimum because if a single LED has a quality problem, the whole module has to be replaced, leading to high maintenance costs. In addition, the LED light sources that are completely covered by epoxy resin lose part of the light emitting therefrom to absorption in the resin, causing a decrease in luminous efficiency. More complex waterproof LED light source module structures have been formed utilizing an upper cover and a lower cover which are fixed by screws to support LED light source. These more complex structures lead to difficulties in manufacturing, leading to high costs, and inconvenient installation and use. Therefore, there is a need for a simple structure waterproof LED light source module that has low manufacturing and maintenance costs.

As discussed above, LEDs have the ability to substitute for a traditional fluorescent lamp. In order to increase lighting brightness, a plurality of LEDs is often incorporated into a single lamp. Unfortunately, an increase in LED light source power also leads to an increase in the heat generated by LED, which greatly decreases light extraction efficiency and service life of the LED. In order to address these issues, the manufacturers of LED light source modules often adopt a metal case having good heat conduction capabilities. Although this can solve the heat dissipation issue of an LED light source module, the manufacturing process is complicated and costly, which increases difficulty in the practical application of the LED light source modules. For example, a waterproof heat dissipating LED light source module is disclosed in Chinese Patent Publication No. CN2824292, which comprises a metal case and a strip circuit board installed in the metal case. The strip circuit board is welded with a light emitting diode, a resistor and a power input line, and a heat dissipating potting adhesive covers the strip circuit board and its driving element. However, the LED light source module is not convenient for installation and fixation and the strip circuit board is required to be fixed inside the metal case. Thus the structure is comparatively complicated and poor in general, rendering it unsuitable for mass production. Therefore, there is a need for a simple LED light source module that has low manufacturing and maintenance costs.

Despite improvements in LED light source technology, there are still unmet needs such as those mentioned above for a new and improved LED light source module. Specifically, an LED light source module capable of heat and/or water resistance that comprises a simple structure that is able to be manufactured and maintained at low cost is desired.

SUMMARY OF THE INVENTION

The numerous limitations inherent in the currently available LED light source modules described above provide great incentive for new, better LED light source modules capable of accounting for one or more of these issues. The present invention relates to an LED light source module that can withstand a harsh environment (e.g., extreme temperatures and humidity) and has a simplified structure that is easy to manufacture and maintain.

Embodiments of the invention include a highly-protective heat dissipating LED light source module comprising: a metal substrate; at least one light emitting diode installed on the metal substrate which is welded with an electronic component and a power line; and a plastic case; wherein the plastic case is injection molded on the upper surface and periphery of the metal substrate to form a half-encapsulated structure. In certain embodiments, the LED light source module may or may not be waterproof.

Other embodiments of the present invention provide a highly protective, heat dissipating LED light source module comprising: a circuit board that comprises at least two through holes; at least one light emitting diode installed on the circuit board which is welded with an electronic component and a power line; and a plastic case; wherein the bottom of plastic case comprises at least two pins with shape and position corresponding to the through holes of the circuit board; and wherein the plastic case and the circuit board are capable of being connected and secured together by inserting the pins into the through holes (e.g., by way of an interference fit or pressure fit). In embodiments, the LED light source module is waterproof or non-waterproof.

In another embodiment, the LED light source modules described herein may comprise one LED light source module or multiple LED light source modules, e.g., in parallel connection with one another.

Preferred embodiments include an LED light source module comprising: a waterproof housing comprising a metal substrate and a plastic cover integrally disposed on one or more surfaces of the metal substrate; and at least one light emitting diode, electronic component, and power line disposed on and operably connected with the metal substrate and encapsulated thereon by the plastic cover.

Also included are such LED light source modules, wherein the housing is integrally disposed on the metal substrate by injection molding. Even further, the LED light source modules can be configured to comprise one or more reflector cups formed into the plastic cover to increase light emission from a corresponding light emitting diode disposed on the substrate.

Especially preferred is an LED light source module of claim 2, wherein the plastic cover is integrally disposed on the metal substrate in a manner that provides a partially encapsulated substrate. The LED light source modules can be configured such that the metal substrate is an elongated member and the plastic cover encapsulates all but one surface of the substrate which is capable of operating as a heat sink for the module.

For increased heat sink capabilities, the LED light source modules can be configured such that the metal substrate is an elongated member and the plastic cover encapsulates more than 50% of the substrate surfaces. The plastic cover can be configured to encapsulate the entire substrate, but leaving one or more sides exposed may increase the heat sink capabilities of the devices and systems of the invention. For example, leaving up to 5% of the surface of the substrate exposed for this purpose may provide for some heat dissipation capability while leaving up to 95% of the substrate surface exposed would provide for substantial heat sink capabilities. Ideally, the surface of and type of metal used in the substrate is configured to maximize heat dissipation properties, such as using copper or gold or adding fins or ribs to increase surface area. Ceramic substrates can also be used.

The LED light source modules of embodiments of the invention can further comprise corresponding through holes disposed in and through each of the plastic cover and metal substrate for enabling fixation of the module to a support.

Further, the type and size of the light emitting diodes used in the modules of the invention are not critical and one of ordinary skill in the art would be sufficiently equipped with the knowledge to select an appropriate size and type LED for a particular purpose. Such LEDs include surface mountable (SMD-type) light emitting diodes. Additionally, the LED light source modules can comprise light emitting diode(s) that are white LED or full-color LED.

The LED light source modules can be configured such that the surface of the substrate that is not encapsulated by the plastic cover comprises radiating fins or ribs.

Light source module systems are also included within the scope of the invention, including an LED light source module system comprising, in parallel connection with one another, a plurality of light source modules as described in this application.

Embodiments of the invention further include an LED light source module comprising: a circuit board with at least two through holes disposed at selected positions; at least one light emitting diode, electronic component, and power line disposed on the circuit board and operably connected therewith; and a plastic cover comprising at least two pins disposed and shaped for interconnection with corresponding through holes of the circuit board.

Such LED light source modules can comprise pins integrally formed in the plastic cover and configured to protrude from the circuit board when inserted into the through holes of the circuit board and to provide for a fixed connection between the plastic cover and circuit board. The LED light source modules of the invention include embodiments with plastic cases or covers, wherein at least a portion of the securing pins are wider than the corresponding through holes to provide a fixed, interference fit. The plastic cover can be configured for contacting an upper surface of the circuit board, for contacting the upper surface and periphery of the circuit board, or for encapsulating otherwise only a portion of the substrate (e.g., a half-encapsulation embodiment) or encapsulating the entire substrate. When the term "half" is used in this application it is meant to refer to a portion and not exactly 50%.

The LED light source modules can further comprise corresponding through holes disposed in and through each of the plastic cover and metal substrate for enabling fixation of the module to a support. The through hole of the plastic cover can be further configured to have side walls of a shape and size to enable insertion into and fixing of it by interference fit together with the corresponding through hole of the circuit board.

Preferred are such modules having one or more reflector cup for a corresponding light emitting diode disposed on the substrate is provided by the plastic cover.

The features of novelty and various other advantages that characterize the invention are pointed out with particularity in the claims forming a part hereof. However, for a better understanding of the invention, its advantages, and the objects obtained by its use, reference should be made to the drawings that form a further part hereof, and to the accompanying descriptive matter, in that there is illustrated and described preferred embodiments of the invention. The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION OF VARIOUS EMBODIMENTS

Figure 1A:
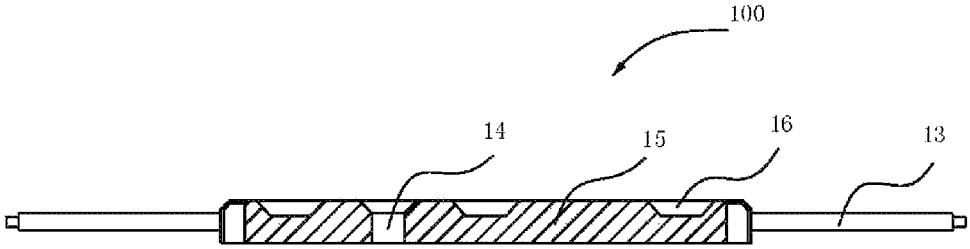
FIGS. 1A-C are schematic illustrations of LED module embodiments of the present invention, including respectively side elevation, and top and bottom planar views.

In accordance with embodiments of the present invention, the present invention is directed to the field of LED light source modules capable of withstanding a harsh environment. More particularly, the present invention relates to a simple LED light source model that may be efficiently and inexpensively produced and is capable of withstanding the harsh environments in which it is sometimes used. One of the many potential advantages of the methods, devices, and systems of the present invention, only some of which are discussed herein, is that embodiments of the invention provide highly-protective light source modules having a simple structure, low cost for both maintenance and production, easy installation and good generality, and can solve the water protection and heat dissipating problems associated with other existing LED modules. This LED light source model may be used for outdoor applications since it provides optimal protection from the environment. For the purposes of this disclosure, this model will be referred to as the waterproof model herein. Another advantage of the present invention includes the a non-waterproof LED light source module which has simple structure, low cost for both maintenance and production, and convenient manufacture that can be done at a large scale. This LED light source model may be used in indoor applications or in outdoor applications with additional protection from the environment. For the purposes of this disclosure, this model will be referred to as the non-waterproof model. These terms are not intended to be limiting and either embodiment can be used in waterproof or non-waterproof applications, as desired, and/or either embodiment can be modified for use in either an environment calling for a waterproof or non-waterproof device. For example, it may be desired to use the waterproof version in applications where waterproof devices are not a requirement and vice versa. Further, although referred to as a non-waterproof version, such embodiments can be made to be waterproof in other ways, such as with potting.

The waterproof model described herein may comprise a highly-protective heat dissipating LED light source module that further comprises a metal substrate, at least one light emitting diode installed on the metal substrate which is welded with an electronic component and a power line, and a plastic case formed on the metal substrate. In certain embodiments, the metal substrate may have an elongated strip shape and may be provided with the power line welding part on the upper surface (e.g., a printed circuit board). In an embodiment, the power input line and power output line may be welded on the two longer sides of the upper surface of the metal substrate respectively. In certain embodiments, the plastic case may be injection molded on the upper surface and periphery of the metal substrate to form a half-encapsulation structure. Alternatively, the plastic cover can be injection molded onto only the upper surface of the substrate circuit board. Indeed, the plastic cover can be injection molded to any and/or all sides or surfaces of the substrate circuit board. Leaving one or more surfaces of the substrate can provide for increased heat dissipation from the device during use.

The injection molding process to adhere the plastic cover to the metal substrate can be performed by any known injection molding process. PVC or ABS plastic materials may be used to prepare the plastic cover. More specifically, the molding process can include placing the metal substrate and the appropriate die corresponding to the particular configuration of plastic cover desired in a position to enable the plastic material to be formed on the substrate and intended internal components of the LED module (i.e., LEDs, power lines, etc.). Colloid material is then injected into the die in one or more stages. Pressure is maintained (e.g., between 20-50 MPa for a couple of seconds or longer, such as at 35 MPa for 2.5 s). Then, the colloid material is allowed to cool for a sufficient period of time to allow for the desired plastic cover to maintain the desired shape and molding quality (for example, about ten seconds or longer, such as 13 s). Prior to molding, it is preferred to bake and mix the colloid material to achieve a desired characteristic, such as hardness. For PVC material, the baking can be performed at about 50-90° C., such as about 75° C., for up to about 2 hours. For ABS material, the baking can be performed at about 60-100° C., such as about 85° C. for up to about 4 hours. Once injection molded onto the substrate, the fused plastic cover and metal substrate form a housing capable of protecting the internal components of the housing (e.g., the LEDs, circuitry, electronic components, etc.) from environmental conditions, such as humidity, heat, or cold.

The plastic case (otherwise referred to as a protective cover) may be provided with a reflector cup capable of being disposed on the light extraction face of the light emitting diode. The light source module may be provided with a fixing through hole with a round, square or diamond shape. In certain embodiments, the light emitting diode may be of any type LED, such as white-type LED or three primary color full-color LED. The light emitting diode may be a surface mountable light emitting diode. The bottom of the metal substrate in the LED light module may be provided with radiating fins or ribs for heat dissipation (i.e., heat sink capabilities).

The waterproof model described herein includes, but is not limited to, the following advantages: (1) the waterproof model uses a metal substrate as the bearing structure of LED device, which effectively increases heat dissipating performance of the LED light source module; (2) the LED light source module may be encapsulated (e.g., partial or complete encapsulation) by a plastic case board, which provides good moisture proof and anti-corrosion performance and satisfies the requirements in outdoor exhibition; moreover, a plastic case helps in heat dissipating and delays module aging; (3) the half-encapsulation plastic case may be integrally molded on the metal substrate which is expected to contribute to low manufacturing costs and a simple production process; and (4) the power input/output line is capable of enabling a parallel circuit type connection among light source modules, so that the failure of a local module will not affect the whole module circuit, thereby decreasing maintenance costs for the model.

The non-waterproof model described herein may comprise a circuit board and at least one light emitting diode installed on the circuit board which is welded with an electronic component and a power line and covered by a plastic case, characterized in that, said circuit board is provided with at least two through holes. In certain embodiments, the bottom of the plastic case may be provided with at least two pins shaped and positioned to correspond for mating with the through holes of the circuit board; said plastic case and said circuit board may be connected by inserting the pins into the through holes. It is noted that the number of pins is not critical and more or less may be desired for particular applications. In an embodiment, part of the pins which are inserted into through holes may be extended from the lower surface of the circuit board, and the cross sectional area of the extended pin part may be larger than that of through hole, forming a fixed pressure-fit ("interference fit") connection between the plastic case and the circuit board. The plastic case may be covered on the upper surface of the circuit board. In some embodiments, the plastic case may encapsulate the upper surface and periphery of the circuit board to form a half-encapsulation structure. In certain embodiments, the circuit board may have a elongated strip shape and be provided with a power line welding part on the upper surface, and the power input line and power output line are welded on two longer sides of the upper surface of the circuit board respectively. The through hole of said circuit board may be in the shape of cylinder, square or diamond, or any shape applicable for a certain purpose. The circuit board may be provided with at least a first fixing hole, and a second fixing hole may be formed on said plastic case above the first fixing hole of the circuit board correspondingly, wherein the second fixing hole may be connected with the first fixing hole to form a through hole; the first fixing hole has any shape, including the shape of cylinder, square or diamond. Said second fixing hole may be inserted into the first fixing hole and part of it may be extended from the lower surface of the circuit board. The circuit board described in this disclosure may be a metal substrate or PCB. In certain embodiments, the plastic case may form a light extraction hole on the light extraction surface of the light emitting diode; said light extraction hole may have the shape of inverted-trapezoid, cylinder or square, for example. The light emitting diode described in this disclosure may be a white LED or three primary color full-color LED. Said light emitting diode may be a surface mountable light emitting diode.

The non-waterproof model described herein includes, but is not limited to, the following advantages: (1) in the non-waterproof model, the pin at the bottom of the plastic case may inserted into the through hole and part of it may be extended from the lower surface of the circuit board, and/or the extended pin part has a cross sectional area larger than that of through hole after hot-pressing to form a fixed connection between the plastic case and the circuit board; thus encapsulation of epoxy resin may not be necessary, and the utility model features simple structure leading to inexpensive and convenient manufacture; (2) the LED light source module may be covered by a plastic case on the upper surface of the circuit board, or the upper surface and periphery of the circuit board may be encapsulated by the plastic case to form half-encapsulation structure, thus having good dust-proof and anti-corrosion performance; (3) the lower surface of the circuit board may be in contact with outside air directly without being encapsulated by the plastic case, which helps to improve the heat dissipating performance of LED light source module and to delay module aging; and (4) the power input/output line can be operably configured to enable parallel circuit connection among light source modules, so that local failure of a module unit may not affect the whole module circuit.

In embodiments of both the waterproof and non-waterproof models disclosed herein, there can be one LED light source module or multiple LED light source modules in parallel connection. A person of ordinary skill in the art, with the benefit of this disclosure, would know the type and amount of LED light source necessary for a specific application.

Figure 1B:
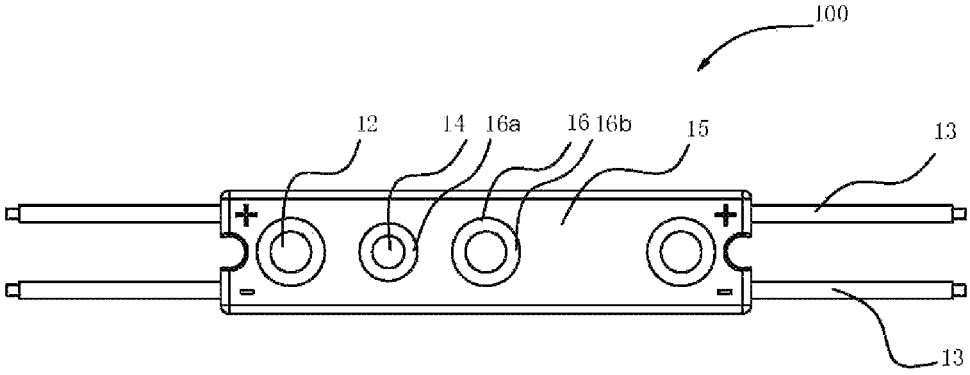
Figure 1C:
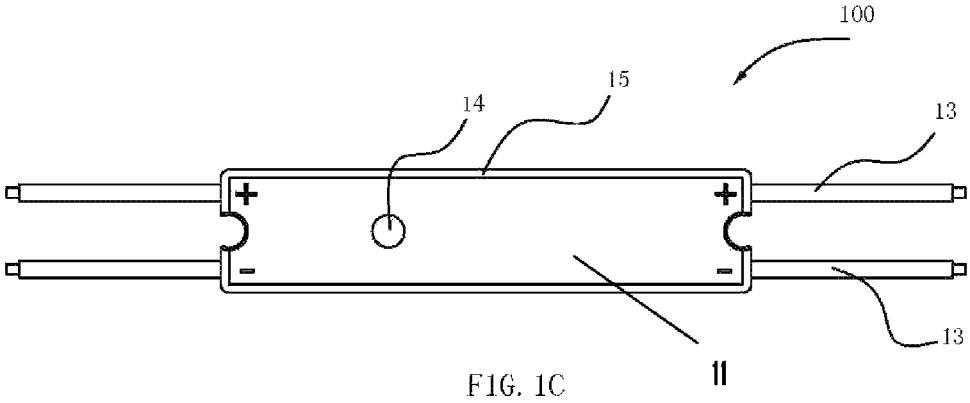

Referring now to the Figures, and in particular to FIGS. 1A-C, the figures illustrate one embodiment of a highly-protective, waterproof, and heat dissipating LED light source module (100), which comprises a metal substrate (11) and at least one light emitting diode (12). The substrate can also be plastic, but metal is preferred for increased heat dissipation capabilities. In this embodiment, the metal substrate may be electrically connected to the light emitting diode(s) which are welded with a power line (13). As shown, there are power input (13) and power output lines (13) disposed on both ends of the elongated LED module (100) to provide electrical current to the LEDs during use of the module. A through hole (14) is provided on the metal substrate. In the embodiment shown in FIG. 1B, a plastic case (15) is formed on the upper surface and periphery of the metal substrate to cover said metal substrate, the additional electronic components (not shown) and part of the power line. As shown in FIG. 1C, the periphery of plastic case (15) is shown encircling the perimeter of the circuit board (11). In the pictured embodiment of FIGS. 1A-C, the plastic case (15) also comprises a through hole operably configured to correspond in shape and size to the through hole (14) of the circuit board (11). Together, the through hole of the substrate and the corresponding through hole of the plastic cover comprise means for installing the LED module to a surface, for example, by way of a screw or other securing means which is capable of passing through the LED module to secure the LED module to a support. Further, on the light extraction face of the light emitting diode (12) disposed on the circuit board (11), the through hole of the plastic case (15) may be designed to be cup shaped comprising a slanted face (16*a*) to enable easy installation and fixation of the LED module to a supporting surface and to provide for a recessed area for the head of a screw to reside to ensure there are no unwanted protrusions on the face of the LED module. Additional through holes are provided in the plastic case (15) to correspond with each LED (12) to permit light to escape the LED module when plastic case (15) is disposed on the circuit board (11). These through holes preferably have a slanted face (16*b*) as well, which is a surface providing a transition from the through hole encircling the LED to the top surface of the plastic case (15) and ending at edge (16). Additionally, surface (16*b*) may be polished to play the role of reflector cup at the light extraction face of the LED (12) to increase light utilization efficiency of light emitting diode.

Figure 2A:
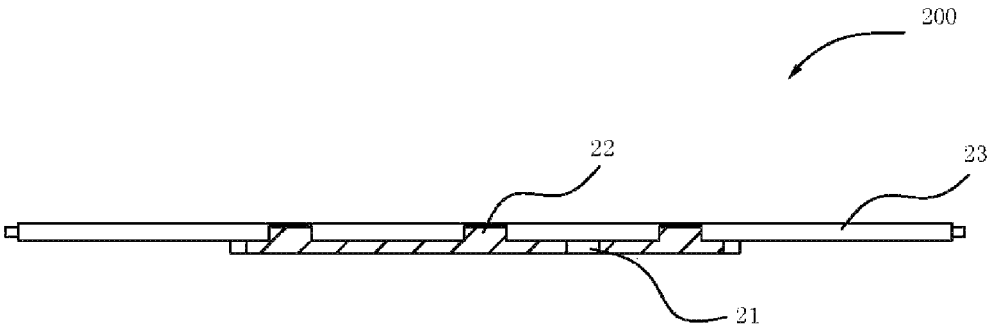
FIGS. 2A and 2B are schematic illustrations of the LED light source module shown in FIGS. 1A-C with the protective housing removed and demonstrating respectively a side elevation view and a top perspective view of the module embodiment.
Figure 2B:
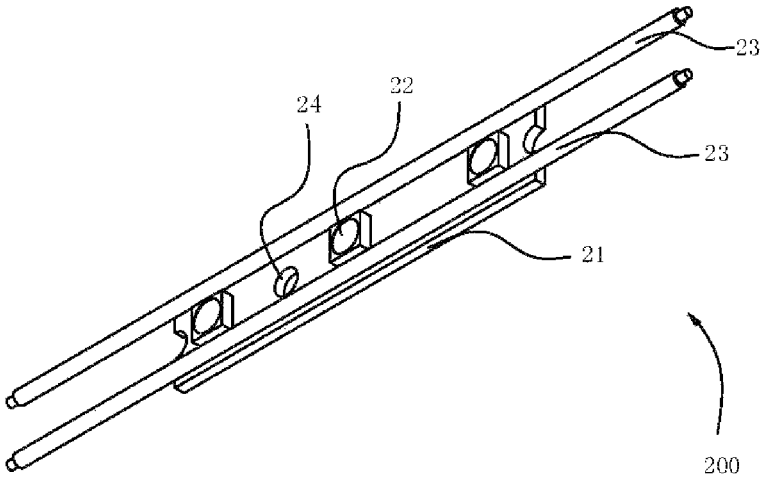

FIGS. 2A-B provide additional views of the highly-protective, waterproof, and heat dissipating LED light source module (200) of FIGS. 1A-C, without the plastic case. In the above-mentioned structure, the metal substrate (21) comprises a through hole (24) and at least one light-emitting diode (22). Here, three LEDs are shown on each LED module unit, but any number of LEDs can be used, including for example 1-10 LEDs for each module or module unit. In some embodiments the through hole (24) is preferably a cylinder through hole as shown here, but can be of any desired shape or size. The metal substrate (24) may comprise an elongated overall shape and be provided with power line welding on the upper surface. In this embodiment, the input and output power lines (23) are welded on two longer sides of the upper surface of the metal substrate respectively, so as to realize an electrical connection between the metal substrate and the external power. In certain embodiments, the metal substrate may also be provided with drive elements such as resistor and capacitor which may be welded with the circuit of metal substrate.

Figure 3:
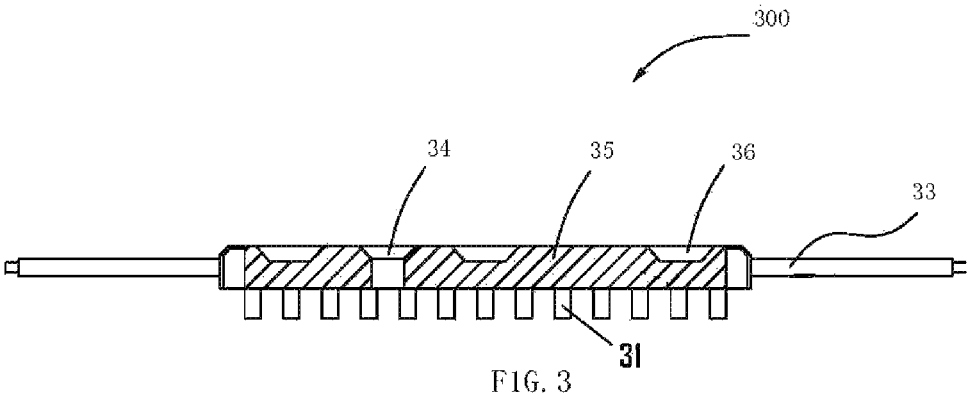
FIG. 3 is a schematic illustration of an LED light source module according to embodiments of the invention, shown with a side elevation view.

FIG. 3 illustrates another embodiment of the highly-protective, waterproof, and heat dissipating LED light source module (300) that has the same basic structure as the LED light source module shown and described in FIGS. 1 and 2. As shown in this embodiment, the LED module comprises a metal substrate (31) with a through hole (34), a reflector cup (36), and input and output power lines (33); and is further encased by a plastic case (35). The difference between this embodiment and that of FIGS. 1 and 2 above is that the bottom of the metal substrate is provided with additional heat sink capabilities, e.g., fins or ribs, or other means for radiating heat away from the LED module unit.

Figure 4A:
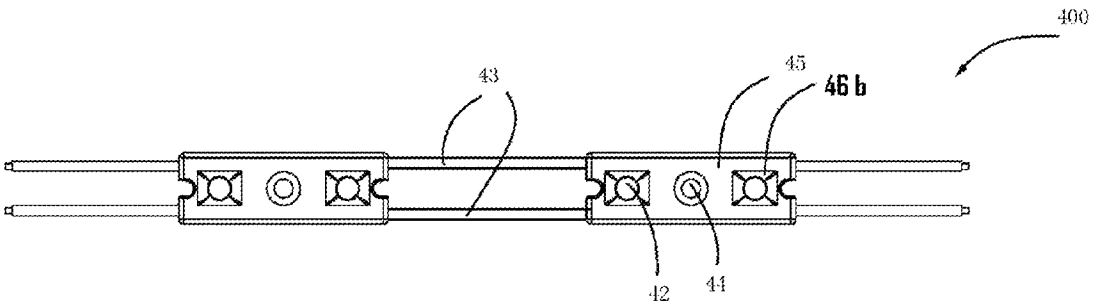
FIG. 4A is a schematic illustration of an LED light source module of the invention comprising multiple modules, each with two LEDs, with the module units connected in parallel.
Figure 4B:
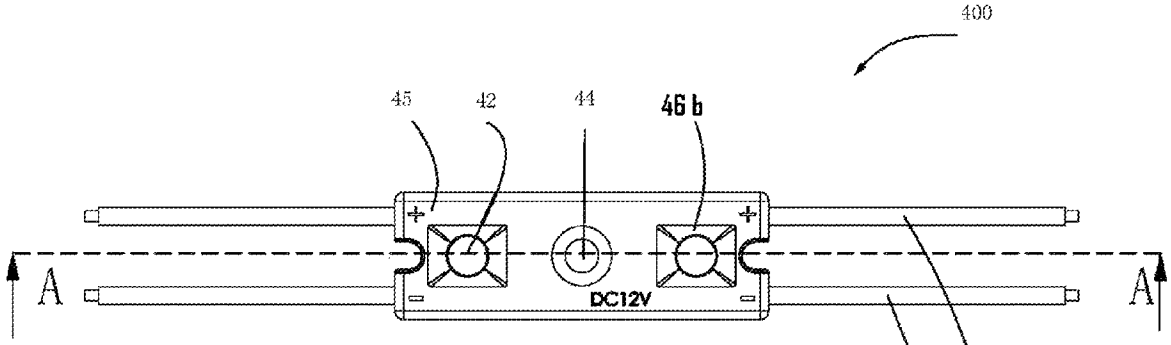
FIGS. 4B-D are schematic illustrations of an LED module according to an embodiment of the invention comprising two LED light sources and showing respectively a top planar view, a side elevation view, and an end elevation view of the module.
Figure 4D:
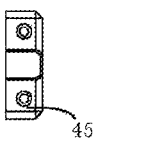
Figure 4C:
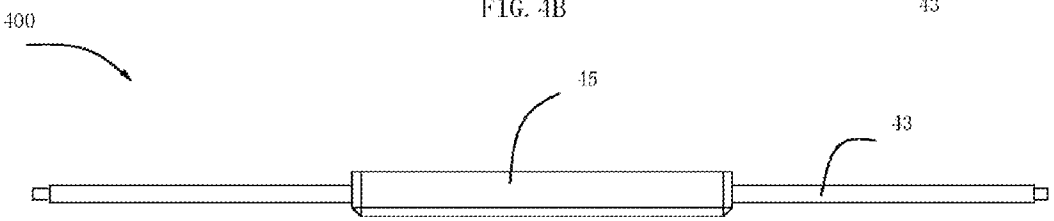

FIGS. 4A-C illustrate yet another embodiment of the highly-protective, waterproof, and heat dissipating LED module (400) that has an LED light source module comprising a metal substrate that comprises two light emitting diodes (42) with reflector cups (46*b*), a through hole (44), and a plastic case encasing the entire periphery of the metal substrate. In this embodiment, the metal substrate may be operably connected with input and output power lines (43) which further may connect a plurality of such LED light source module units in series as shown in FIG. 4A (where two LED module units are connected in parallel).

Figure 5A:
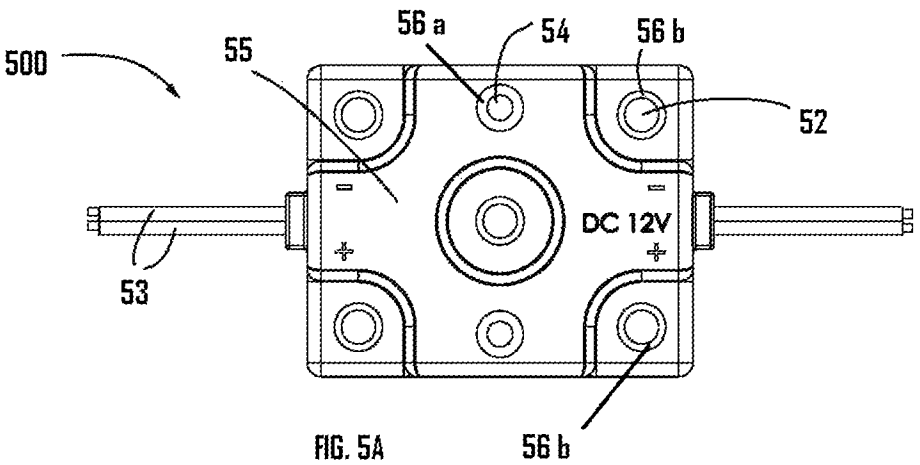
FIGS. 5A-C are schematic illustrations of an LED module embodiment of the invention comprising multiple LED light sources and showing A top planar view (FIG. 5A), a side elevation view (FIG. 5B), and an end elevation view (FIG. 5C).
Figure 5B:
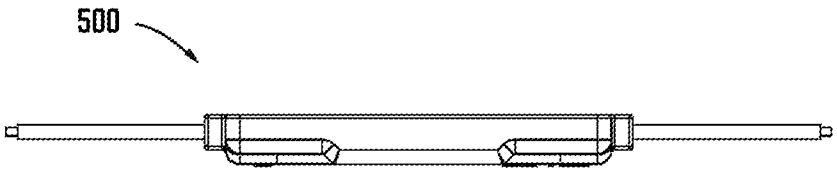
Figure 5C:
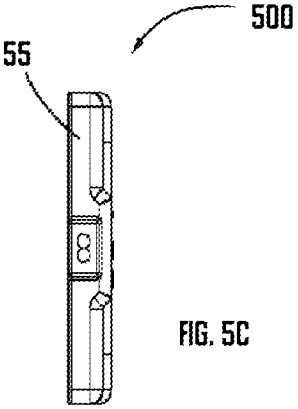

FIGS. 5A-C illustrate yet another embodiment of the highly-protective, waterproof, and heat dissipating LED module (500) that has an LED light source module comprising a metal substrate with five light emitting diodes (52) in operable communication therewith and a plastic cover (55) having reflector cups (56*b*). The metal substrate comprises a through hole (54) operably configured in shape and size to be compatible with a corresponding through hole of the plastic cover (55). Preferably, the corresponding through hole of the plastic cover comprises a transition surface (56*a*), which can be polished to provide a reflector cup for the corresponding LED (52) which it surrounds. The plastic case (55) can encase the entire metal substrate, the upper surface of the metal substrate, or the upper surface and sides of the metal substrate. Even further, the metal substrates may be connected with the input and output power lines (53).

In preferred embodiments discussed herein, the highly-protective, waterproof, heat dissipating LED light source module proposed by the current application adopts an encapsulation structure with metal substrate and plastic case, which greatly increases heat dissipating and protection performance of the LED light source module. The addition of a through hole makes installation of light source module more convenient, which is beneficial for the wide application of LED light source module. The addition of a reflector cup on the plastic case increases light utilization efficiency of LED light source module. Compared to conventional light source modules with metal cases, the disclosed waterproof model comprises a plastic case integrally molded on the metal substrate, which greatly simplifies the production process of the light source module and effectively reduces manufacturing costs.

Referring now to FIGS. 6A-F, the figures illustrate one embodiment of a highly protective, non-waterproof, heat dissipating LED light source module (600), which comprises a circuit board (61), at least one light emitting diode (62) electrically connected with the circuit board, power lines (63) connected with the circuit of the circuit board, and a plastic case (65) covering said circuit board. In the above-mentioned structure, both ends of the circuit board comprise through holes (64) that are preferably symmetrically placed. Moreover, the circuit board may further comprise a first fixing hole (67). The through holes and first fixing holes may have any shape including, but not limited to, cylinder, square or diamond. In certain embodiments a cylinder shaped through hole and first fixing hole is preferable. The difference between the first fixing hole (67) and the through holes (64) of the circuit board is that, the first fixing hole may be used for installation and fixation of the LED light source module to a support or support surface (e.g., by using a screw, nail, or other connecting means), while the through hole may be used for fixation of the circuit board to the plastic case.

The circuit board in this embodiment is a long strip (e.g., an elongated planar member) and there may be a power lines (63) connecting the circuit board and the external power to provide means for an electrical current to travel from the power source to and through the circuit board and from the circuit board. In this embodiment, the circuit board may also include drive elements such as resistor and capacitor which are welded within a circuit of the circuit board. In the non-waterproof embodiments, the circuit board can be any material including, but not limited to, a metal substrate or a printed circuit board (PCB). In this embodiment a metal circuit board would be preferable. For example, an aluminum substrate with good heat conductive effect may be used so that the heat generated in light emission of the light emitting diode (62) may be quickly conducted by the aluminum substrate and then dissipated into outside air, so as to delay module aging.

Figure 6A:
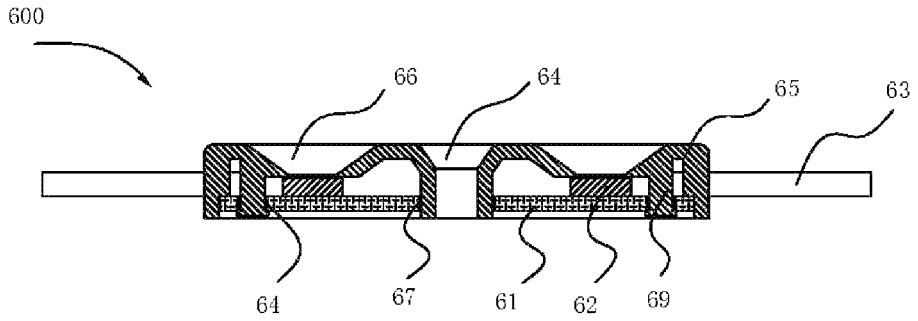
FIGS. 6A-F are schematic illustrations of an LED light source module according to an embodiment of the invention, provided respectively in a side elevation view, a top planar view, a bottom planar view, an end elevation view, a top perspective view, and a top perspective view demonstrating the LED module with the protective cover removed.

As illustrated by FIG. 6A, a plastic case (65) encapsulates the upper surface and periphery of the circuit board (61) to form a half-encapsulation structure, which covers said circuit board, the additional electronic component (not shown), and part of the power line (63). Such an encapsulated embodiment is capable of providing greater stability than embodiments where the plastic cover rests on the surface of the substrate or circuit board and provides an increased aesthetic appearance. In this embodiment, the plastic case comprises a light extraction hole (66) and a through hole, which can also be referred to as a fixing hole (64), on the light extraction face of the light emitting diode (62). Preferably, the fixing hole (64) of the plastic cover is of a shape and size that corresponds with through hole (67) of the substrate, such that the two holes are capable of cooperating together to provide a through hole that passes entirely through the LED module for facilitating installation of the LED module to a support. In preferred embodiments and as shown, the fixing hole (64) of the plastic cover may be inserted into the fixing hole (67) of the substrate while part of the structure forming fixing hole (64) of the plastic case may remain extended from the lower surface of the circuit board so as to prevent or minimize damage to the circuit board during installation and fixation of the LED module to a support using, for example, a screw. The light extraction hole (66) may have any shape including, but not limited to, an inverted-trapezoid, cylinder or square. In the embodiment shown, the light extraction hole is designed as an inverted-trapezoid shape, so as to control the light-emitting angle of light emitting diode, reduce light source waste and achieve an optimal light-emitting effect.

Figure 6B:
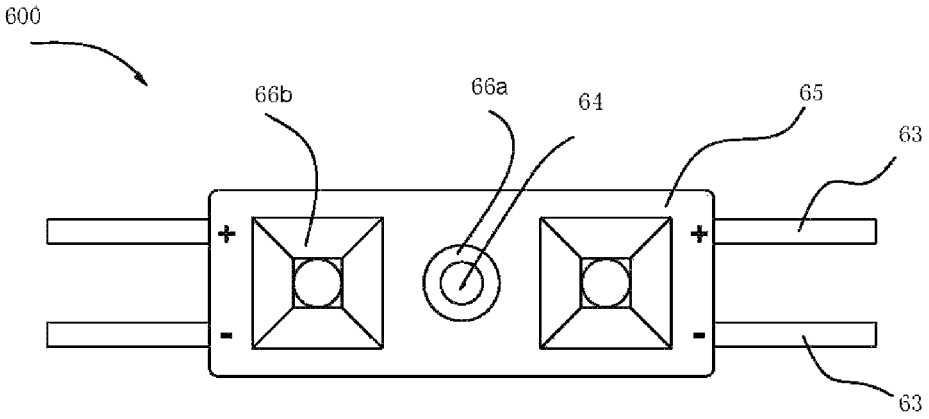
Figure 6C:
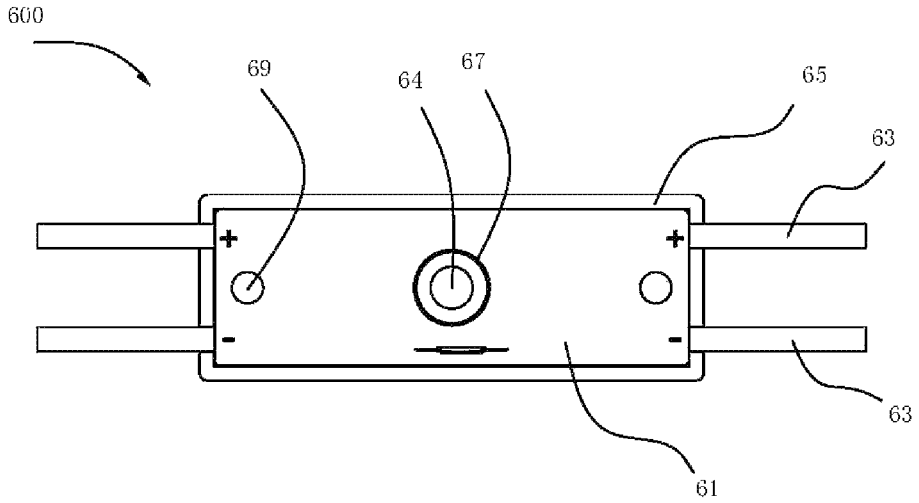
Figure 6D:
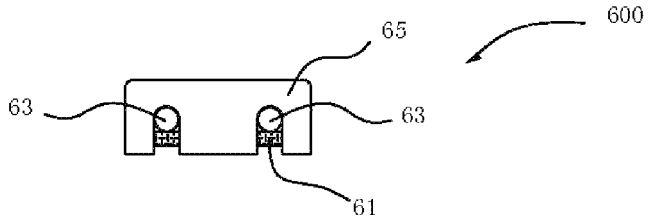
Figure 6E:
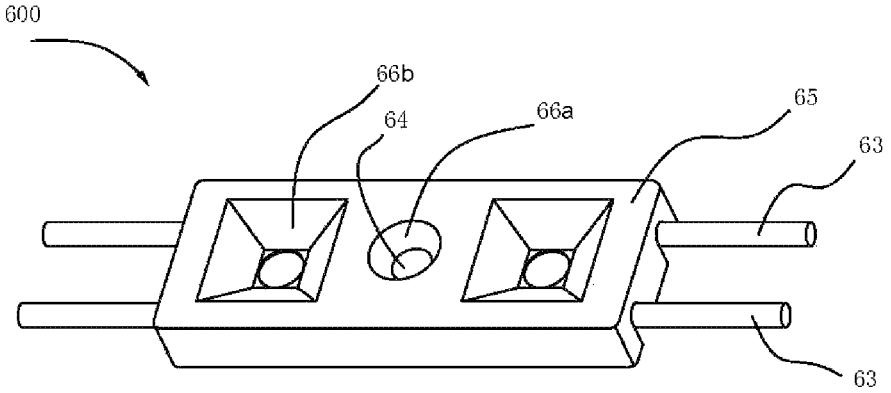
Figure 6F:
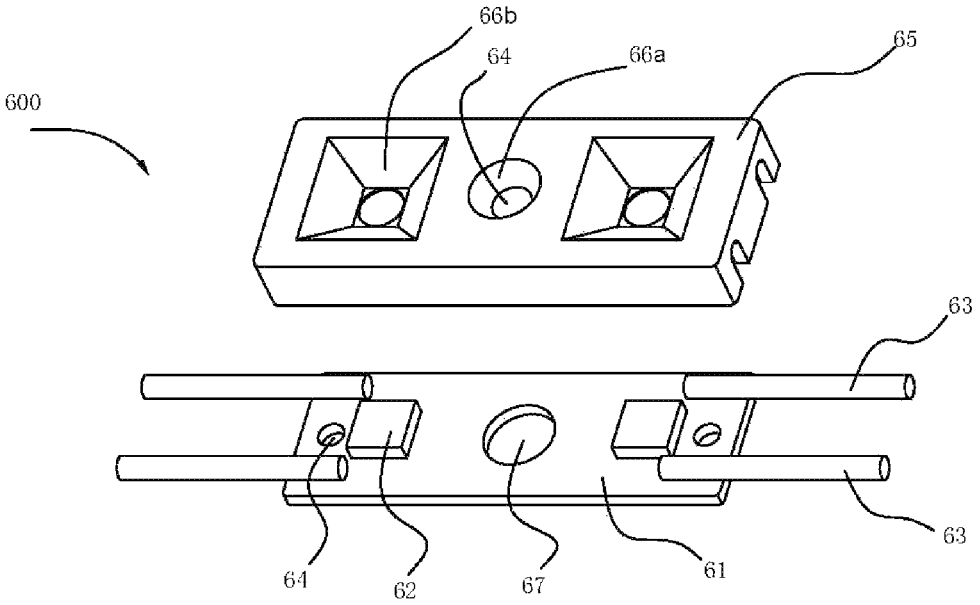

FIG. 6B provides a top planar view of the LED light source module, FIG. 6C provides a bottom planar view of the LED light source module, FIG. 6D provides a side elevation view, FIG. 6E provides a top perspective view, and FIG. 6F provides a top perspective view (with the plastic cover removed) of the LED light source module. Of particular note in FIGS. 6B, 6E, and 6F, the trapezoidal shape of the reflector cup (66*b*) is exemplified. As shown in FIG. 6C, the bottom of the plastic case (65) comprises two pins (69). The pins have a shape and are positioned to correspond with the through holes (64) on the circuit board (61), and said pins are capable of being inserted into the through holes leaving part of the pins (69) preferably to extend from the lower surface of the circuit board. Said pins and the plastic case may be injection molded integrally. The extended pin part may have a cross sectional area larger than that of the through hole after hot-pressing that allows a fixed connection to form between the plastic case and the circuit board, which renders a simple structure that leads to convenient manufacture because the encapsulation of epoxy resin is not necessary.

Therefore the instant application provides a highly-protective, non-waterproof, heat dissipating LED light source module that comprises a simple structure and can be conveniently manufactured. The production efficiency of LED light source modules is thereby increased. At the same time, the design of the through hole (i.e., the fixing or installation hole) makes the installation of the light source module convenient, which is beneficial for the wide application of LED light source modules. The light extraction hole on the plastic case may be designed to be an inverted-trapezoid cup shape, which controls light-emitting angle of the light-emitting diode, reduces light source waste and increases light utilization rate of the LED light source module. Compared to conventional LED light source modules which adopt epoxy resin for large-area encapsulation to realize fixed connection between circuit board and case, this highly-protective, non-waterproof, heat dissipating LED light source module simplifies production process of light source module, saves material and effectively reduces manufacturing and maintenance costs by utilizing hot-pressing to form a fixed connection.

Figure 7:
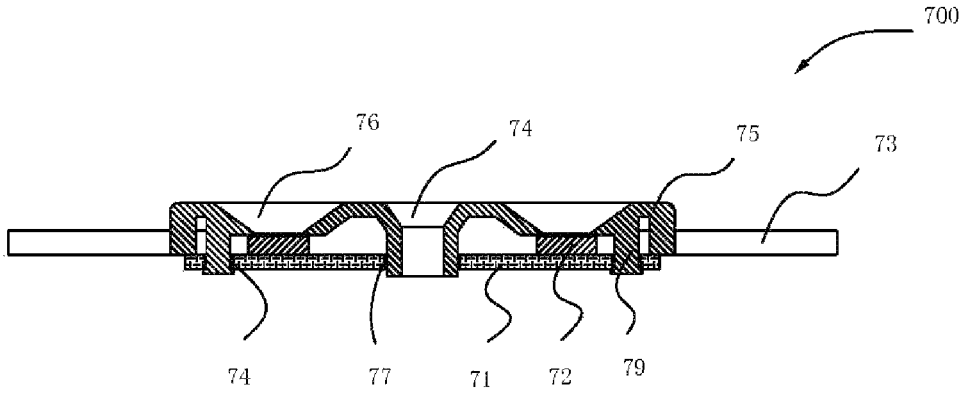
FIG. 7 is a schematic illustration of an LED module embodiment of the invention shown in a side elevation view.

Referring now to FIG. 7, an LED light source module (700) is provided having the same basic structure as the LED light source module described in FIGS. 6A-F. In this embodiment, the plastic case (75) does not encapsulate the periphery of the circuit board (71) to form half-encapsulation structure; instead, the plastic cover is disposed and covers only the upper surface of the circuit board. The plastic case comprises a through hole (74) for fixing the LED module to a support, a reflector cup forming a through hole (76), and pins (79). The substrate (71) comprises corresponding through holes (74) and a through hole for fixing (77), with pins (79), and LEDs (72) disposed on the circuit board.

Figure 8A:
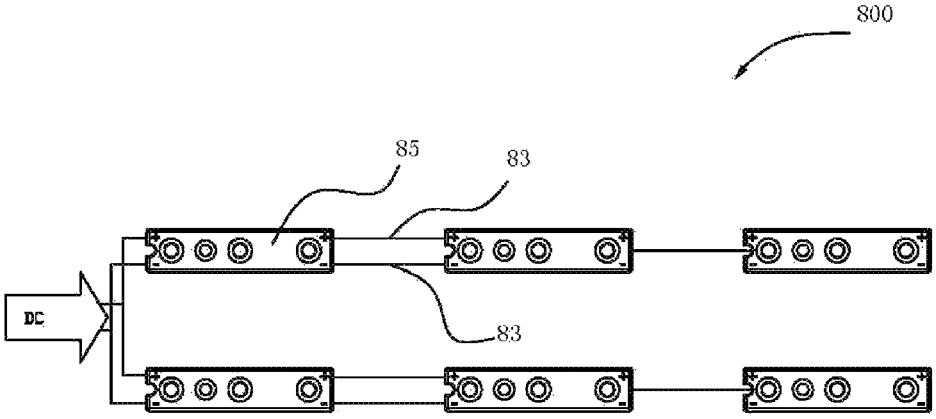
FIGS. 8A-B are schematic illustrations of LED module embodiments according to the invention comprising multiple LED light source module units connected in parallel.
Figure 8B:
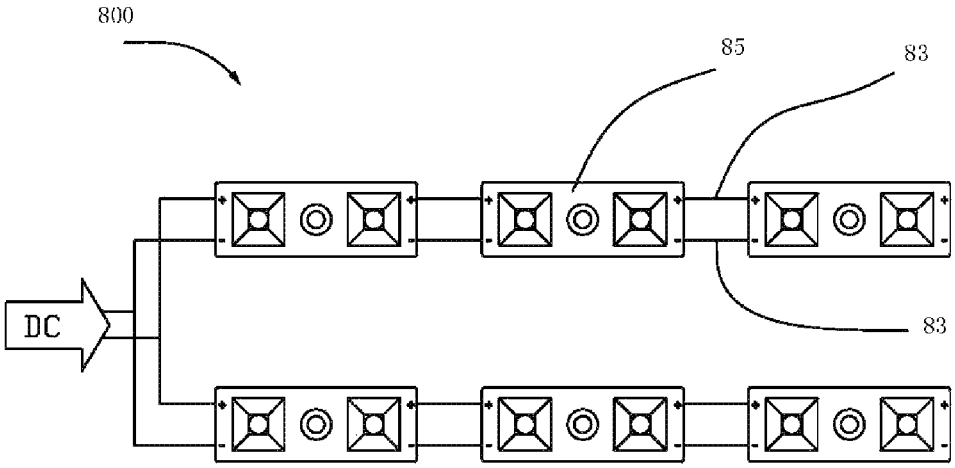

A plurality of LED light source modules can be connected to form a lighting system. FIGS. 8A and 8B show configurations for LED light source module systems (800) according to embodiments of the invention. More particularly, FIG. 8A illustrates an embodiment comprising a plurality of LED light source modules (800) in parallel connection to form a light source module system, wherein each LED light source module unit has the structure (including plastic cover (85) and power lines (83)) as any one or more of the above-mentioned highly-protective, waterproof, heat emitting LED light source modules. In this embodiment, each LED light source module of the light source module system (800) has the same basic structure as the LED light source modules discussed in the above waterproof embodiment, but is equally applicable to non-waterproof variants.

FIG. 8B illustrates yet another embodiment of the highly-protective, waterproof, and heat dissipating LED light source model (800). This LED light source module has the same basic structure as the LED light source module shown in the embodiment in FIGS. 1 and 2, the difference is that, this LED light source module comprises a system (800) having a plurality of LED light source modules in parallel connection. Each LED light source module unit (800) has the same structure as any one or more of the above-mentioned LED light source modules having a plastic case (85) and connected through multiple power lines (83). This embodiment can also be modified to provide for non-waterproof variants.

The light emitting diode provided in any and all embodiments of the present invention may be any type of LED including, but not limited to, a surface mount device (SMD) LED or a lead frame LED. The light emitting diode provided in embodiments of the present invention may be any color LED including, but not limited to, white, blue, red, yellow, orange, green, purple, violet, ultraviolet, and any combination thereof. The particular type of LEDs used will depend on the specific function needed to be sustained and promoted. SMD white LEDs may be preferred in the embodiments disclosed herein.

There are several ways by which the light emitting diode may be electrically connected with the metal substrate in the embodiments of this invention. Such ways include, but are not limited to, splicing, clamping or welding. Welding may be preferred in the embodiments disclosed herein.

The plastic case disclosed herein may have an integral molding structure. The plastic case may be made up of any material that would provide protection for its encased components. In certain embodiments, the material of plastic case may preferably be PVC plastic material. One of ordinary skill in the art, with the benefit of this disclosure, would know the type of plastic case to use depending on the specific application for the LED light source module and the specific type and number of LEDs used.

The embodiments mentioned above are some of the preferred embodiments of the utility model without limiting the detailed implementation scope of the utility model. The scope of these models is not limited to the embodiments described and any equivalent change made according to the shape, size, configuration, and/or structure of the utility model is included in the scope of the utility model.

Directional indicators provided in this application, including forward, backward, within, along, top, bottom, horizontal, vertical, and the like, are provided merely to assist in understanding the principles of the invention with respect to representative embodiments and are not intended to be restrictive. It is understood that orientations may change for various applications and that it is within the ordinary skill of the art to adjust nomenclature accordingly.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention. It is intended that the specification and examples be considered as exemplary in nature and that variations that do not depart from the essence of the invention are intended to be within the scope of the invention.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. While embodiments are described in terms of "comprising," "containing," or "including" various components or steps, the embodiment can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. Whenever it is indicated that "any" amount may be used, it should be understood that any and every value is applicable. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined in this specification. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. An LED light source module comprising:

a waterproof housing comprising a metal substrate and a plastic cover integrally disposed on one or more surfaces of the metal substrate; and at least one light emitting diode (LED), electronic component, and power line disposed on and operably connected with the metal substrate and encapsulated thereon by the plastic cover;

wherein the plastic cover comprises a through hole disposed above each light emitting diode to permit light to escape the LED module and the plastic cover is in direct contact with each light emitting diode;

and wherein the plastic cover and the metal substrate each comprise a through hole which cooperate together to provide a fixing hole for fixation of the waterproof housing to a support, which fixing hole passes entirely through the module.

2. The LED light source module of claim 1, wherein the housing is integrally disposed on the metal substrate by injection molding.

3. The LED light source module of claim 2, wherein one or more reflector cup is provided by the plastic cover.

4. The light source module of claim 3, wherein one or more of the reflector cups has four slanted faces.

5. The LED light source module of claim 2, wherein the plastic cover is integrally disposed on the metal substrate in a manner that provides a partially encapsulated substrate.

6. The LED light source module of claim 5, wherein the metal substrate is an elongated member and the plastic cover encapsulates all but one exposed surface of the substrate which exposed surface is capable of operating as a heat sink for the module.

7. The LED light source module of claim 6, wherein the surface of the substrate not encapsulated by the plastic cover comprises radiating fins or ribs.

8. The LED light source module of claim 5, wherein the metal substrate is an elongated member and the plastic cover encapsulates more than 50% of the substrate surfaces.

9. The LED light source module of claim 2, wherein the light emitting diode is a surface mountable (SMD-type) light emitting diode.

10. The LED light source module of claim 2, wherein the light emitting diode(s) are white LED or full-color LED.

11. An LED light source module system comprising, in parallel connection with one another, a plurality of light source modules of claim 1.

12. The LED light source module of claim 1, wherein a periphery of the plastic cover encircles the metal substrate.

13. The LED light source module of claim 12, wherein the plastic cover is integrally disposed on the metal substrate in a manner that provides a partially encapsulated substrate.

14. An LED light source module comprising:

a circuit board with at least two through holes disposed at selected positions;

at least one light emitting diode, electronic component, and power line disposed on the circuit board and operably connected therewith; and a plastic cover in direct contact with each light emitting diode, and comprising at least one hole to permit light to escape the LED module, and comprising at least two pins disposed and shaped for interconnection with corresponding through holes of the circuit board;

wherein the pins are integrally formed in the plastic cover;

wherein at least one of the pins of the plastic cover is a hollow pin with a through hole;

and the plastic cover is disposed on the circuit board such that the through hole of the hollow pin of the plastic cover and a through hole of the circuit board align to provide a fixing hole passing entirely through the light source module for fixing the light source module to a support surface.

15. The LED light source module of claim 14, wherein the plastic cover comprises at least three pins and the circuit board comprises at least three through holes, wherein the pins of the plastic cover are configured to provide for a fixed connection between the plastic cover and circuit board.

16. The LED light source module of claim 15, wherein at least a portion of the pins are wider than the corresponding through holes to provide a fixed, interference fit between the pins and the through holes.

17. The LED light source module of claim 16, wherein a periphery of the plastic cover encircles the metal substrate.

18. The LED light source module of claim 14, wherein one or more reflector cup is provided by the plastic cover.

19. An LED light source module system comprising, in parallel connection with one another, a plurality of light source modules of claim 14.

20. The light source module of claim 14 comprising two fixing holes.

* * * * *